US010317015B2

(12) United States Patent
Joye et al.

(10) Patent No.: US 10,317,015 B2
(45) Date of Patent: Jun. 11, 2019

(54) LIGHT MODULE WITH SELF-ALIGNING ELECTRICAL AND MECHANICAL CONNECTION

(71) Applicants: Michael Joye, Carlsbad, CA (US); John James Hradnansky, Carlsbad, CA (US)

(72) Inventors: Michael Joye, Carlsbad, CA (US); John James Hradnansky, Carlsbad, CA (US)

(73) Assignee: Auroralight, Inc., Carlsbad, CA (US)

( * ) Notice: Subject to any disclaimer, the term of this patent is extended or adjusted under 35 U.S.C. 154(b) by 0 days.

(21) Appl. No.: 15/242,416

(22) Filed: Aug. 19, 2016

(65) Prior Publication Data

US 2017/0051880 A1 Feb. 23, 2017

Related U.S. Application Data

(60) Provisional application No. 62/207,303, filed on Aug. 19, 2015.

(51) Int. Cl.

| | |
|---|---|
| ***F21K 9/238*** | (2016.01) |
| ***F21V 23/02*** | (2006.01) |
| ***F21K 9/23*** | (2016.01) |
| *F21V 29/70* | (2015.01) |
| *F21V 23/00* | (2015.01) |
| *F21Y 115/10* | (2016.01) |
| *F21V 23/06* | (2006.01) |

(52) U.S. Cl.

CPC ..... *F21K 9/238* (2016.08); *F21K 9/23* (2016.08); *F21V 23/02* (2013.01); *F21V 23/006* (2013.01); *F21V 23/06* (2013.01); *F21V 29/70* (2015.01); *F21Y 2115/10* (2016.08)

(58) Field of Classification Search

CPC .. F21K 9/23–9/238; F21V 23/02; F21V 23/06

See application file for complete search history.

(56) References Cited

U.S. PATENT DOCUMENTS

| | | | | |
|---|---|---|---|---|
| 4,932,882 | A | 6/1990 | Kang | |
| 5,704,792 | A | 1/1998 | Sobhani | |
| 7,255,463 | B2 | 8/2007 | Wang et al. | |
| 7,264,479 | B1 * | 9/2007 | Lee | H01R 11/30 439/39 |
| 7,540,761 | B2 | 6/2009 | Weber et al. | |
| 8,534,867 | B1 | 9/2013 | Beadle | |
| 8,641,234 | B2 | 2/2014 | Dube et al. | |
| 8,651,711 | B2 | 2/2014 | Rudisill et al. | |
| 8,933,616 | B2 | 1/2015 | Keser et al. | |
| 2006/0013000 | A1 | 1/2006 | Coushaine et al. | |

(Continued)

*Primary Examiner* — Anh T Mai
*Assistant Examiner* — Steven Y Horikoshi
(74) *Attorney, Agent, or Firm* — John K. Buche; Bryce A. Johnson; Buche & Associates, P.C.

(57) ABSTRACT

Generally disclosed may be an LED lighting module (including but not limited to lamps, light bulbs, or light fixtures) with (i) rapidly replaceable LED light source units, (ii) rapidly replaceable driver circuitry, and (iii) efficient heat transfer. An aspect of the rapid replaceability of the disclosed light source is self-registration of the source's light elements, electronic drive components, and heat sources respectively relative to the optical, power supply components, and heat sink components of a lamp or other lighting device.

7 Claims, 10 Drawing Sheets

(56) References Cited

U.S. PATENT DOCUMENTS

| | | | | |
|---|---|---|---|---|
| 2008/0174247 | A1 | 7/2008 | Yu et al. | |
| 2013/0241426 | A1* | 9/2013 | Dohn | F21V 31/04 315/200 R |
| 2013/0322089 | A1 | 12/2013 | Martis et al. | |
| 2014/0049972 | A1* | 2/2014 | McGuire | F21V 21/00 362/427 |

* cited by examiner

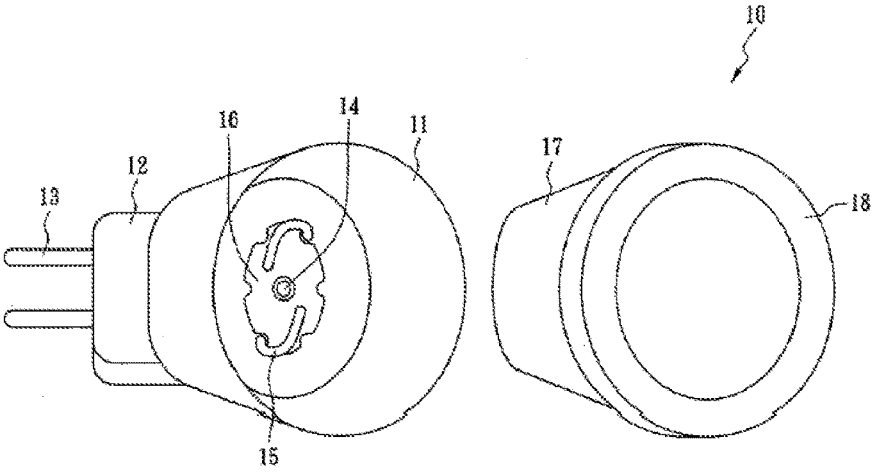
FIG. 1D (PRIOR ART)
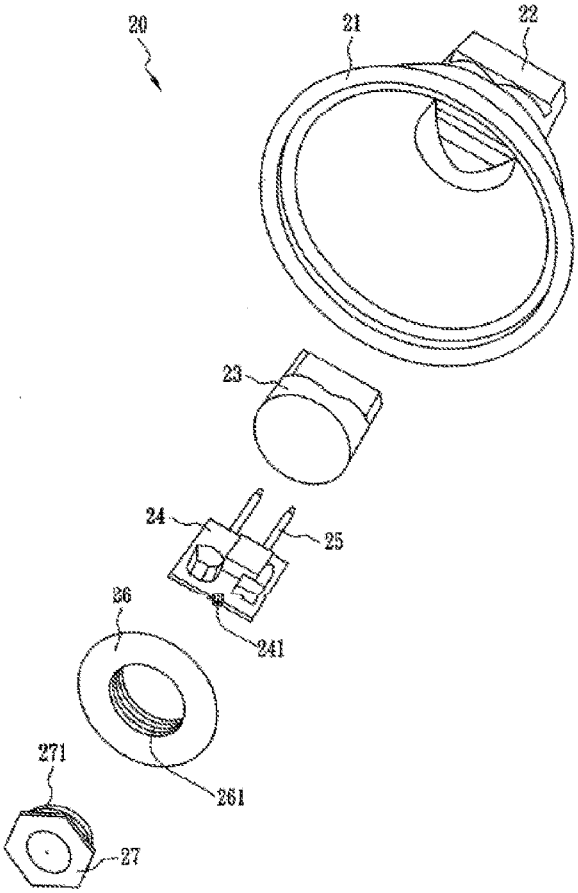
FIG. 2 (*Yu et al.*)

LIGHT MODULE WITH SELF-ALIGNING ELECTRICAL AND MECHANICAL CONNECTION

CROSS-REFERENCE TO RELATED APPLICATIONS

This application claims the benefit and priority of U.S. Prov. App. Ser. No. 62/207,303 (filed Aug. 19, 2015) by Michael Joye entitled "Light emitting diode lamps and related methods."

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

REFERENCE TO AN APPENDIX SUBMITTED ON A COMPACT DISC AND AN INCORPORATED BY REFERENCE OF THE MATERIAL ON THE COMPACT DISC

Not applicable.

STATEMENT REGARDING PRIOR DISCLOSURES BY THE INVENTOR OR A JOINT INVENTOR

Reserved for a later date, if necessary.

BACKGROUND OF THE INVENTION

Field of Invention

The present application is in the field of light emitting diode (LED) lamps and related methods.

Background of the Invention

An LED is a two-lead semiconductor light source. LEDs have become widespread for use in lighting applications because LEDs are favorably smaller in size, lower in power consumption, longer in life, and offer quicker response speeds than alternative incandescent or fluorescent light sources. Although better than alternative light sources, LED lamps can be inefficient, where in some cases, 80% to 85% of input power is converted to heat rather than light. This inefficiency can result in heat buildup and, if the heat is not dissipated effectively, light emitting intensity and service life of the LED light source are reduced significantly.

LED lamps or light bulbs are assemblies with an LED light source for use in lighting fixtures and other lighting applications. A traditional (prior art) LED bulb or lamp is an MR-16 high power LED lamp. FIG. 1A is a prospective view of a typical MR-16 high powered LED lamp bulb 10. FIG. 1B is a side view of the MR-16 high powered LED lamp bulb 10 of FIG. 1A. FIG. 1C is an exploded view of the MR-16 high powered LED bulb of FIGS. 1A and 1B. Referring to FIG. 1A through 1C, and FIG. 1C in particular, a traditional MR-16 LED bulb 10 comprises a housing 11, a base 12, a driver circuit and pins 13, LED light source(s) 14, wiring 15, printed circuit board ("PCB") for the LED(s) 16, a lens and/or optic 17, and a retainer ring 18. Typically, the LED light source(s) 14 is(are) secured to the PCB 16 and both (a) mechanically connected to the base 12 and (b) electrically connected to the driver and pins 13 via the wires 15 and screws 19. In use, the light source(s) 14 emit(s) light whenever the driver and pins 13 are electrically connected to a power source (not shown). The lens and optics 17 may be used to focus light emitted from the light source(s) 14 and the snap retainer ring 18 can secure the lens/optics 17 in place. Such traditional LED bulbs are tedious to assemble because, among other reasons, (a) the wiring 15 must be soldered or otherwise connected to the driver and pins 13 and LED light source(s) 14; the PCB 16 must be screwed into the base and housing via a screw driver; and, usually a spanner wrench and other special purpose tools must be had for dismantling and reassembling an LED lamp.

Another embodiment of typical LED lamps are generally shown and described by U.S. Pat. App. Pub. 2008/0174247 (published Jul. 24, 2008) by Yu et al. Referring to FIG. 1 of Yu et al. (reproduced as FIG. 1D in this specification), a traditional MR-16 LED bulb 10 comprises a housing 11, a base 12, driver and pins 13, an LED light source 14, wiring 15, insulation 16, a lens/optic 17, and a cover 18. Yu et al., ¶[0007]. Typically, the LED light source 14 is secured to the insulation 16 and both (a) mechanically connected to the base 12 and (b) electrically connected to the driver and pins 13 via the wires 15. Id. In use, the light source 14 emits light whenever the driver and pins 13 are electrically connected to a power source (not shown). Id. The lens/optic 17 may be used to focus light emitted from the light source 14 and the cover 18 can secure the lens/optic 17 in place. Such traditional LED bulbs are tedious to assemble because, among other reasons, the wiring 15 must be soldered or otherwise connected to the driver and pins 13 and LED light source 14.

Traditional LED lamps, like the MR-16 lamp, have also not adequately addressed the heat-dissipation problems associated with LED light sources. For instance, heat cannot be effectively dissipated from the LED light source in a traditional bulb because the LED is positioned on insulation or a PCB. As discussed above, heat build-up can degrade the LED and, if the LED is damaged, it is more cost effective and time-efficient to replace the entire lamp than tediously replace the LED. Likewise, when failure of driver circuitry or driver components occurs, these are equally difficult and impractical to replace. Thus, an improved LED lamp is needed that effectively dissipates heat from the LED light source and/or that allows damaged LED light sources and/or damaged driver circuitry to be easily replaced. All of these problems render such MR-16 bulbs unserviceable.

One attempt to meet the aforementioned need is disclosed by Yu et al. Specifically, Yu et al. discloses, with reference to Yu et al.'s FIGS. 2 (reproduced as FIG. 2 in this document), an LED lamp 20 with an LED light source 27, a housing 21, heat-dissipation glue 23, a circuit board 24, and a femininely threaded adapter 26. Id., ¶[0020]. The LED light source 27 is a threaded cylinder wherein the threads 271 are a negative electrode for the LED and the base of the cylinder is a positive electrode for the LED. Id., ¶[0024]. The circuit board 24 features pins 25 and a positive contact point 241. As disclosed by Yu et al., the circuit board 24 and adapter 26 are glued, via the heat-dissipation glue 23, into the bottom of the housing 21 so that the circuit board 21 is underneath the adapter 26. Id. ¶[0021]. When so assembled, the LED light source 27 may be threaded, via its negative electrode 271, into the adaptor 26 until its positive electrode contacts the positive contact point 241 of the circuit board 24. Id., ¶[0021]. In this design: (a) heat may be transferred to the ambient environment via the mechanical contacts between the LED light source 27, adapter 26, circuit board 24, glue 23, and the housing 21; and (b) the LED light source 27 may be readily replaced via unscrewing the component 27 from the adapter 26.

Although an improvement to traditional LED lamps, the lamp disclosed by Yu et al. has various limitations. For instance, the threading of a small LED light source into an equally small adapter can be tedious and requires tools. In addition, a glue gun may be required in the assembly of the lamp. Furthermore, machining the threads for the LED light source and adapter of Yu et al.'s lamp requires exact tolerances or else the assembly cannot be constructed. Additionally, when a driver component or components fail, replacement is difficult since the driver 24 is glued into the housing 21 and may also require unsoldering and re-soldering of wires to effect such replacement. Finally, Yu et al.'s LED lamp accomplishes heat transfer to the ambient environment via the conduction of heat through the interface of several components of the lamp, which is less efficient than conductive heat transfer through the interface of two or less components of the lamp. Thus, a need still exists for LED lamps that effectively dissipate heat from an LED light source and that allow damaged LED light sources and drivers to be easily replaced.

SUMMARY OF THE INVENTION

It is an objective of this disclosure to describe an LED lighting module (including but not limited to lamps, light bulbs, or light fixtures) with (i) rapidly replaceable LED light source units, (ii) rapidly replaceable driver circuitry, and (iii) efficient heat dissipation. An aspect of the rapid replaceability of the disclosed light source is self-registration of the source's light elements, electronic drive components, and heat sources respectively relative to the optical, power leads or pins, and heat sink components of a lamp or other lighting device. It is yet another object of the present application to meet the aforementioned needs without any of the drawbacks associated with apparatus heretofore known for the same purpose. It is yet still a further objective to meet these needs in an efficient and inexpensive manner.

In view of the foregoing, disclosed is an LED lighting module with (i) rapidly replaceable LED light source units (ii) rapidly replaceable driver circuitry, and (iii) efficient heat dissipation. In a most general preferred embodiment, an LED lighting module comprises: an LED light source, driver board, and heat dissipation elements that each respectively self-register relative to optical lenses, power leads or pins, and/or heat sink components of a lamp or other lighting device. Preferably, self-registration may be accomplished via at least one of (a) corresponding geometries between the various components of the LED lighting device, (b) power transmission regions, areas or zones on the LED lighting module that interface with power leads or pin(s) of the lamp or lighting device, or (c) thermal conduction regions, areas or zones that interface with heat dissipation elements of the lamp or lighting device. Suitably, coupling of the LED lighting module and the lamp or lighting device components may be accomplished via screw-fit, snap-fit, twist-lock-fit, press-fit or any other mechanical coupling mechanism or technique. Corresponding geometries could mean that the LED module and relevant components of the lamp or lighting device are round, disc, conical or cylindrical, square, cube, triangular, or any other cooperating geometries.

In a preferred embodiment, the module comprises: a base; a heat-sink housing; a light source unit, light source assembly, or a light source board with two circular power rings and a thermal conduction ring; a driver board or other electrical control module with power leads or pins and corresponding positive and negative pogo pins; wherein an electrical power connection between the light source unit/assembly/board and the driver/control module is accomplished via compressing the spring loaded pogo pins against the circular power rings; and, wherein the heat sink housing interfaces with the thermal conduction ring to accomplish a heat transfer connection between the light source unit/assembly/board and heat sink housing. Although pogo pins are preferred, any type of electromechanical contact could be used (except that plug-and-socket-type connections are less preferable).

A preferred embodiment of the LED lighting module minimally comprises: an LED light source assembly; power transmission ring(s); at least one thermal conduction ring; at least one electrical contact pogo pin; a base; and a housing. The pogo pins could be any type of electromechanical contact capable of accomplishing similar electromechanical functions (e.g., electrical connectivity via mechanical contact). In said preferred embodiment, the parts of the module may be connected by interfacing male and female threads and sandwich fits, with all of the inner assemblies and parts self-registering. However, other embodiments include connection of parts via snap-fit, twist-lock-fit, or press-fit, wherein the power transmission regions, areas or zones and thermal conduction regions, areas, or zones may be incorporated instead of rings. In other words, all the parts of the module may self-register, fit together, and assemble very easily, wherein the preferred embodiment utilizes round, conical, or cylindrical assemblies and units that screw and sandwich together.

BRIEF DESCRIPTION OF THE SEVERAL VIEWS OF THE DRAWINGS

Other objectives of the disclosure will become apparent to those skilled in the art once the invention has been shown and described. The manner in which these objectives and other desirable characteristics can be obtained is explained in the following description and attached figures in which:

FIG. 1D is a reproduction of Yu et al.'s FIG. 1;

FIG. 2 is a reproduction of Yu et al.'s FIG. 2;

It is to be noted, however, that the appended figures illustrate only typical embodiments of this invention and are therefore not to be considered limiting of its scope, for the invention may admit to other equally effective embodiments that will be appreciated by those reasonably skilled in the relevant arts. Also, figures are not necessarily made to scale but are representative.

DETAILED DESCRIPTION OF PREFERRED EMBODIMENTS

Generally disclosed is an LED lighting module (including but not limited to lamps, light bulbs, or light fixtures) with (i) rapidly replaceable LED light source units and (ii) rapidly replaceable driver circuitry, and (iii) efficient heat transfer. An aspect of the rapid replaceability of the disclosed lighting device is self-registration of the device's heat sources (e.g., light elements, electronic drive components) relative to the optical, power leads or pins, and finally, heat sink components of the lighting device. Preferably, self-registration may be accomplished via at least one of (a) corresponding geometries between the various components of the LED lighting device, (b) power transmission regions, areas or zones on the LED lighting module that interface with power leads or pins of the lamp or lighting device, or (c) thermal conduction regions, areas or zones that interface with heat dissipation elements of the lamp or lighting device. In a preferred embodiment, the module comprises: a light source unit that is (a) thermally coupled to a heat-sink housing via a thermal conduction ring and (b) electrically coupled to a driver via compression of one or more pogo pins on the driver against one or more power rings on the light source unit. The more specific details of the disclosed module are described with reference to the attached figures.

Figure 1A:
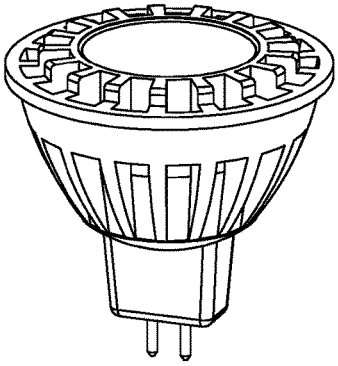
FIG. 1A (PRIOR ART)
FIG. 1A is a perspective view of a prior art MR-16 lamp bulb.
Figure 1B:
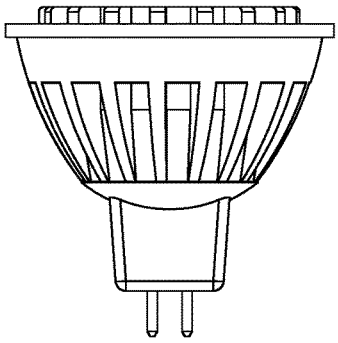
FIG. 1B (PRIOR ART)
FIG. 1B is a side view of the prior art MR-16 lamp bulb of FIG. 1A
Figure 1C:
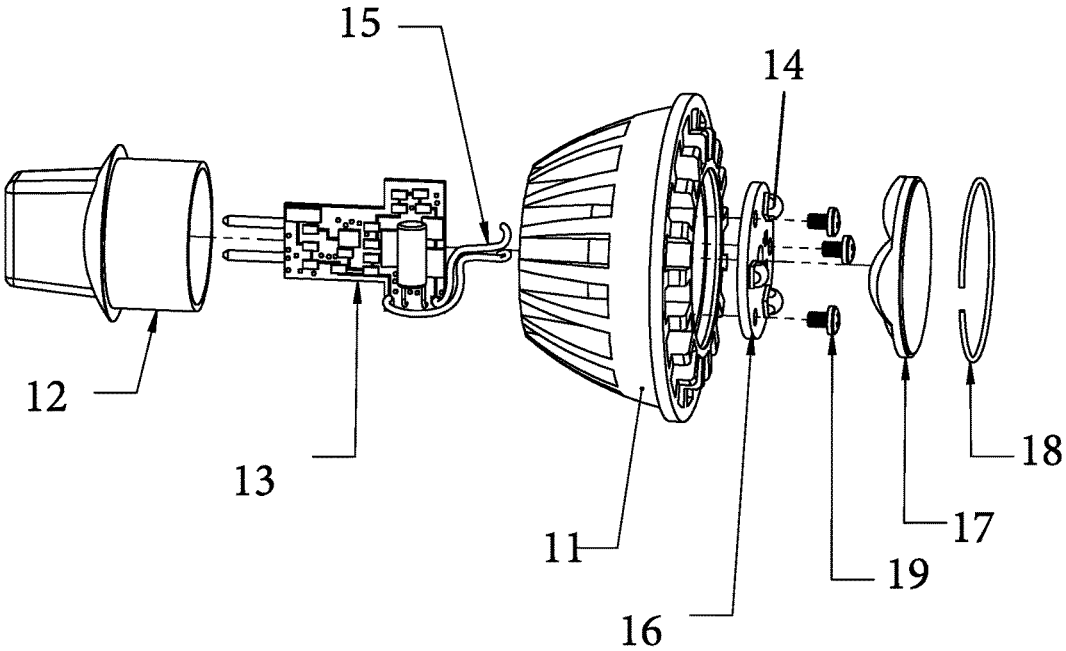
FIG. 1C (PRIOR ART)
FIG. 1C is an exploded view of the prior art MR-16 lamb bulb of FIGS. 1A and 1B.
Figure 3:
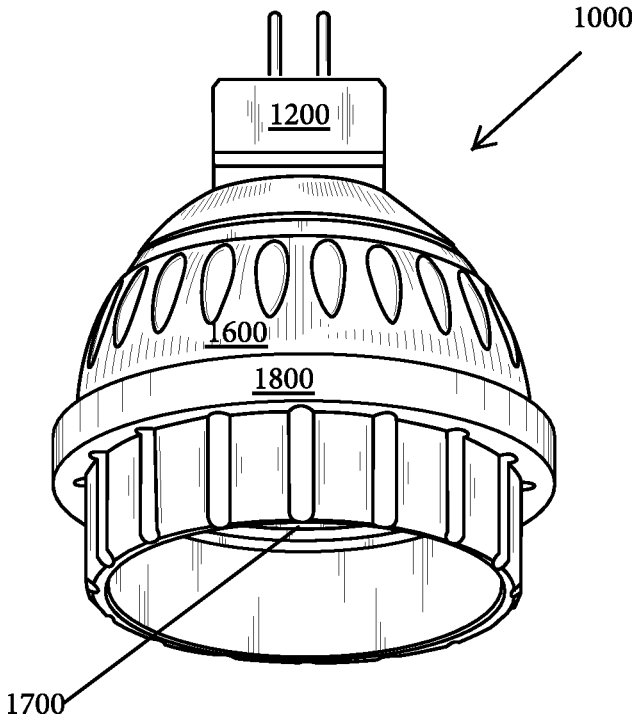
FIG. 3 is a perspective view of an LED lamp 1000.
Figure 4:
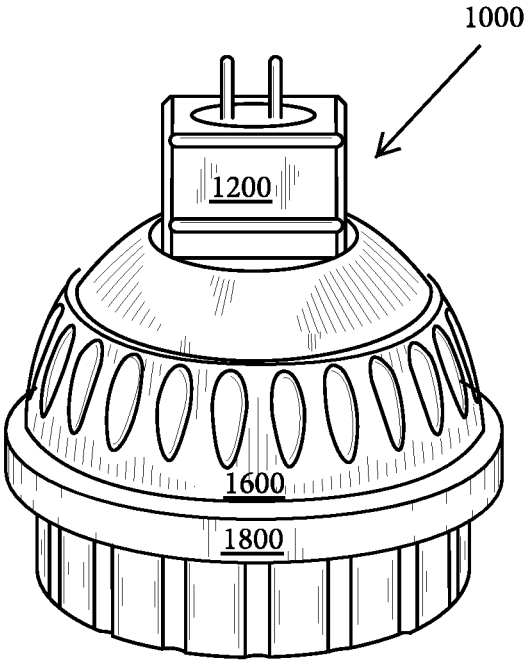
FIG. 4 is another perspective view of the LED lamp 1000.
Figure 5:
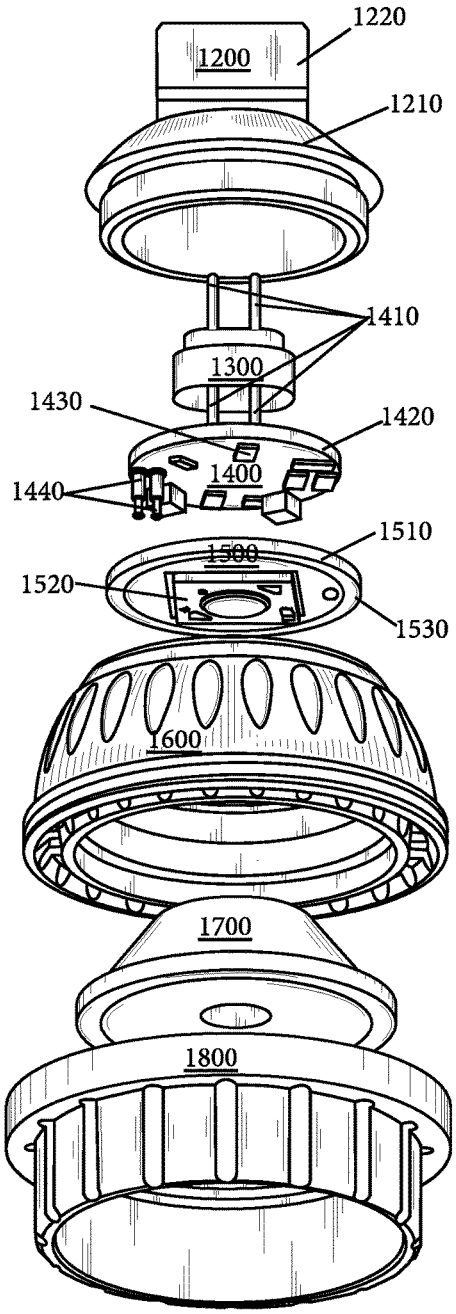
FIG. 5 is an exploded view of the LED lamp 1000.
Figure 6:
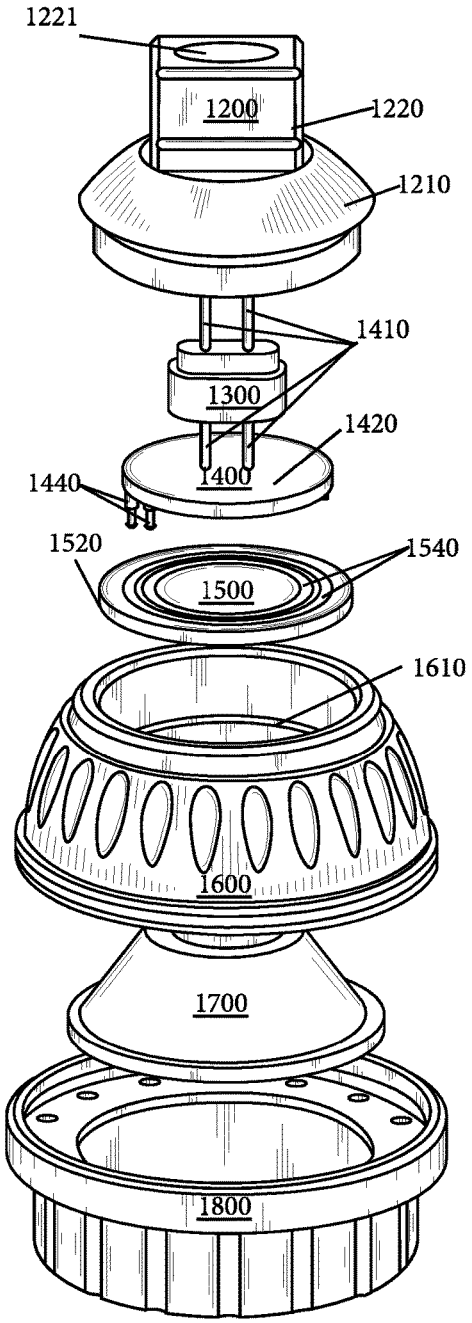
FIG. 6 is another exploded view of the LED lamp 1000.
Figure 7:
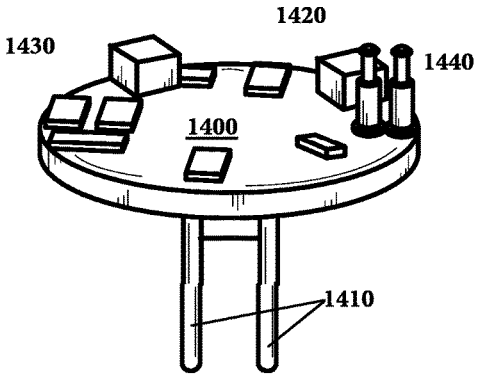
FIG. 7 is a top perspective view of a driver 1400.
Figure 8:
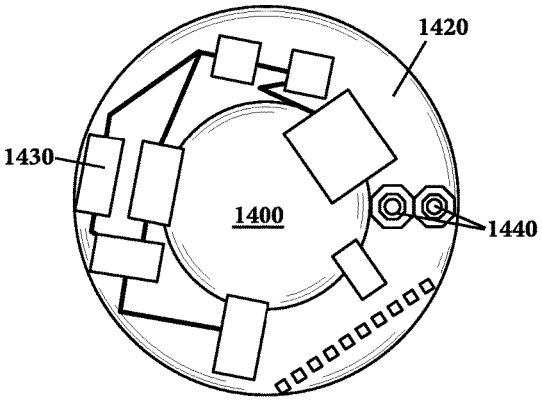
FIG. 8 is a top view of the driver 1400.
Figure 9:
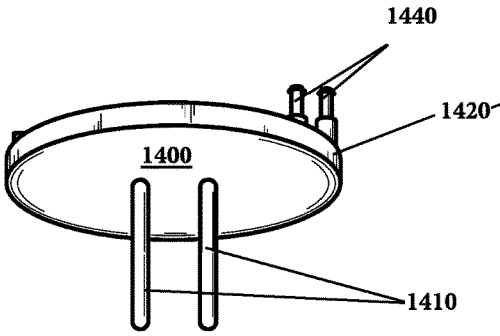
FIG. 9 is a bottom perspective of the driver 1400.

FIGS. 3 and 4 are respectively top and bottom views of a lighting module 1000. FIGS. 5 and 6 are corresponding exploded views of the lighting module 1000 shown in FIGS. 3 and 4. As shown in those figures, the module 1000 comprises: a base 1200; insulator 1300; a driver board 1400; a light source unit 1500; a heat sink housing 1600; an optional optic 1700 (e.g., lens, refractor, waveguide, or reflector); and a retainer ring or apparatus 1800.

Referring only to FIGS. 5 and 6, the base 1200 is defined by a cup-like portion 1210 and a plug retainer 1220 that extends from the basin of the cup like portion 1210. As shown, the plug retainer 1220 is hollow and features an orifice 1221. As discussed later, the orifice 1221 may suitably enable exposure of the pins 1410 of the driver 1400.

Still referring to the exploded views of FIGS. 5 and 6, the insulator 1300 conforms or otherwise complies with the inner contours of the hollow of the plug retainer 1220 of the base 1200. In a preferred embodiment, the insulator 1300 preferably features heat-dissipation or heat-conduction properties. In operation, the insulator 1300 is suitably configured for retaining the driver 1400 within the base 1200 so that the driver's 1400 pins 1410 are exposed at the orifice 1221 of the base 1200 (see, e.g., FIGS. 3 and 4). In one embodiment, the "insulator" 1300 may be a silicone or rubber grommet or other seal that isolates the pins 1410 from the lamp base 1200 and registers the driver 1400 within the base 1200.

Figure 10:
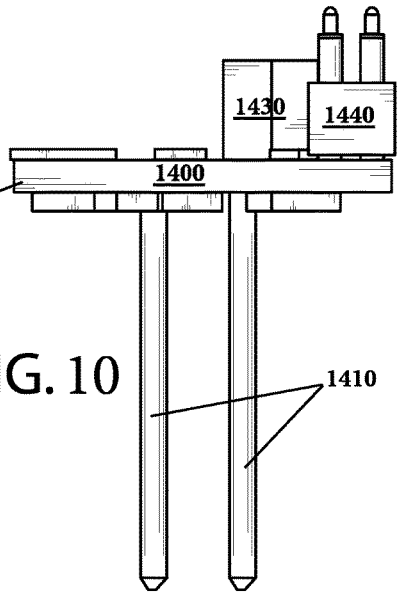
FIG. 10 is a side view of the driver 1400.
Figure 10A:
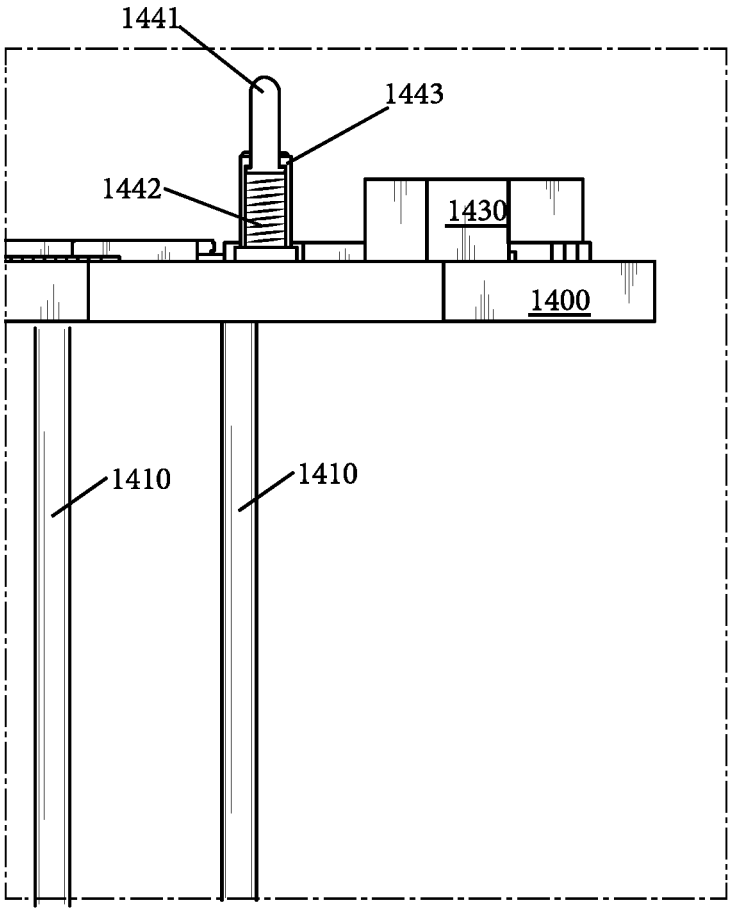
FIG. 10A is a cross section of a pogo pin 1440.
Figure 10B:
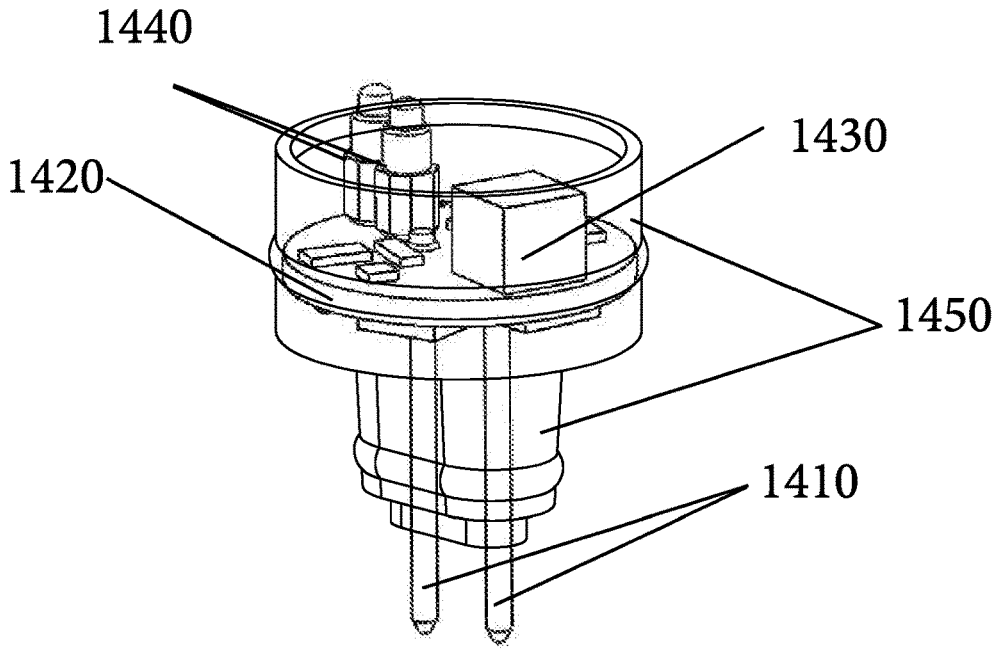
FIG. 10B is a perspective view of a driver 1400 installed in a silicone casing or base 1200.
Figure 10C:
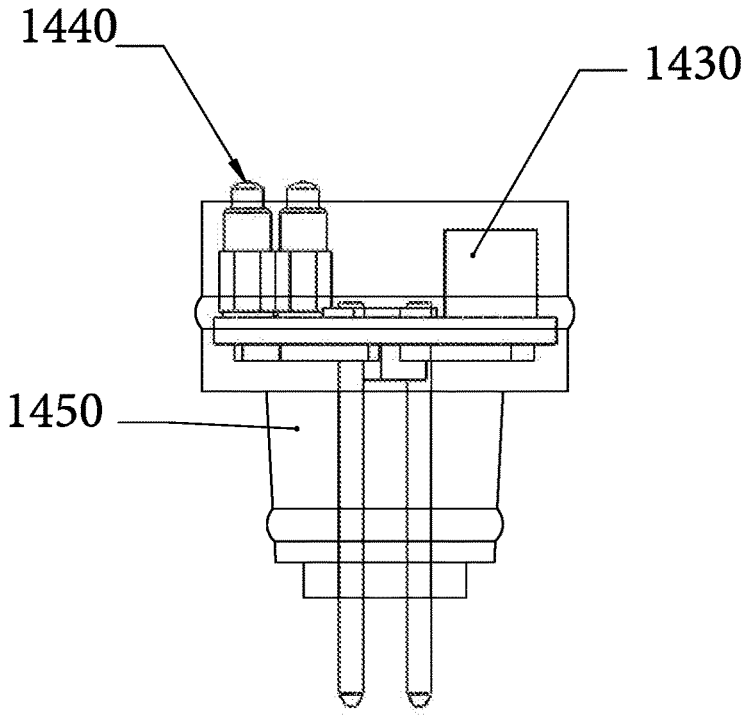
FIG. 10C is a side view of a driver 1400 installed in a silicone casing or base 1200.
Figure 11:
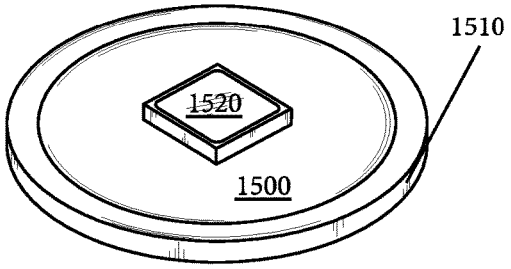
FIG. 11 is a top perspective of a light source unit 1500.
Figure 12:
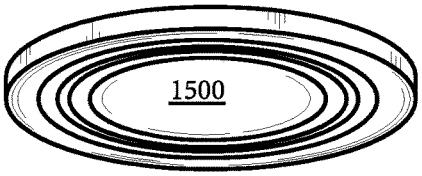
FIG. 12 is a bottom perspective of a light source unit 1500.
Figure 13:
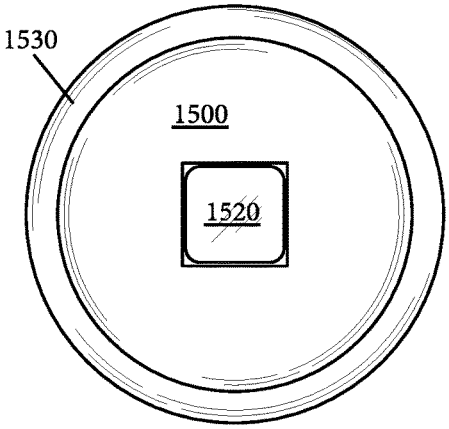
FIG. 13 is a top view of a light source unit 1500.
Figure 14:
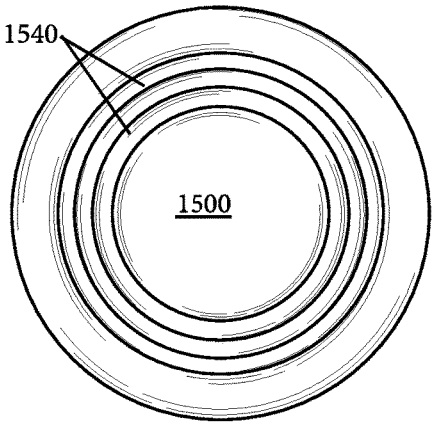
FIG. 14 is a bottom view of the light source unit 1500.
Figure 15:
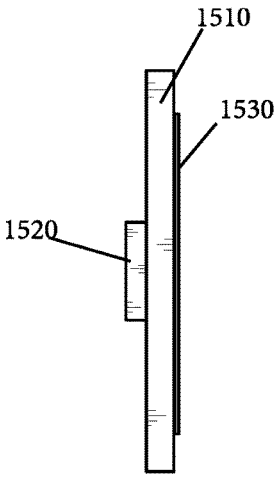
FIG. 15 is a side view of the light source unit 1500.

Yet still referring to FIGS. 5 and 6, the driver 1400 is shown in between the insulator 1300 and the light source unit 1500. FIGS. 7, 8, 9, and 10 respectively illustrate a top perspective view of the driver 1400, a top view of the driver 1400, a bottom perspective of the driver 1400, and a side view of the driver 1400. Referring to FIGS. 7 through 10, the driver 1400 is preferably a disk-shaped board 1420 with two electrical pins 1410 disposed on the underside of the disk 1420. In use, the pins 1410 are ultimately for electrically contacting a power source (not shown) for providing power to the driver 1400. Suitably, the disk 1420 further features electronics 1430 or circuitry for voltage transformation of power from the power source, wherein said electronics are in electrical communication with said pins 1410. Finally, the disk 1420 features pogo pin electrical contact points 1440 that are in electrical contact with the electronics 1430. The pogo pins 1440 may be located on the outer circumference of the disk 1410 and may preferably be arranged side-by-side radially in a row. FIG. 10A illustrates a cross section of a pogo pin 1440. As shown, an electrical conducting pin 1441 floats atop a conductive spring 1442 within a shaft 1443 so that the pin may be compressed (e.g., like a piston) in response to a contact while, at the same time, conduct electricity. Referring back to FIGS. 5 and 6, the driver 1400 is attached within the basin of the cup-like portion 1210 of the base 1200 via the insulator 1300. FIG. 10B is a perspective view of the driver 1400 installed in a silicone casing 1450. FIG. 10C is the side view of a driver 1400 installed in a silicone casing 1450. As shown, the spring loaded pogo pins 1440 or other electromechanical contact of the driver 1400 is positioned in the silicone casing 1450 so that the pogo pins 1440 extend out of the silicone casing 1450 while the pins 1410 extend out of the bottom of the silicone casing 1450, and when installed, out of the base 1200 through orifice 1221. As discussed later below, the pogo pin electrical contact points 1440 may be compressed against the light source unit 1500 so that electricity may flow to the light source unit 1500 from the power source (not shown) via the driver 1400.

Referring again to FIGS. 5 and 6, the light source unit 1500 is shown between the optic 1700 and the driver 1400. FIGS. 11 through 15 respectively illustrate a top perspective view of the unit 1500, a bottom perspective view of the unit 1500, a top view of the unit 1500, a bottom view of the unit 1500, and a side view of the unit 1500. As shown in those figures, the unit is a disk 1510 with (a) an LED 1520 and a thermal conduction ring 1530 on its upper surface; and (b) circular power rings 1540 on its underside surface. Optionally, the disk 1510 can also have a second thermal conduction ring on its lower surface to provide an additional thermal pathway between the disk 1510 and the top edge of the base 1200. In a preferred embodiment, the LED 1520 is secured to the disk. Referring back to FIGS. 5 and 6, the light source unit 1500 is installed within the module 1000 by being sandwiched between the base 1200 and an edge 1610 of the heat-sink housing 1600 so that: the circular power rings 1540 on the underside of the disk 1510 are compressively contacting the pogo pins 1440 of the driver 1400; and the thermal conduction ring 1530 interfaces with the edge

1610 of the heat-sink housing 1600. As discussed further below, the shape of the circular power rings 1540, the compressibility of the pogo pins 1440, and the central position of the LED 1520 allow quick assembly of the module 1000 because the light source unit 1500 may be drop-loaded into the base 1200 over the driver 1400 in any orientation and with minimal regard for misalignment tolerances during assembly while nevertheless accomplishing an electrical contact between the driver 1400 and light source unit 1500. The thermal conduction ring 1530 and edge 1610 of the heat-sink housing 1600 too can be easily interfaced by coaxially positioning heat sink housing 1600 over the light source unit 1500 and base 1200. It should be noted that "centrally" locating the LED 1520 does not exclusively mean the "coaxial" positioning of the LED 1520 on the disk 1510. Instead, "centrally" means anything on top face of the disk 1510 since more than one LED light could be positioned on the disk 1510.

Referring to FIGS. 11 through 15, the disk 1510 is suitably made of solid copper or other metal and incorporates printed circuitry and insulated thru-vias so that electricity may be passed through the disk 1510 from the circular power rings 1540 on the underside of the disk 1510 to the LED 1520 on the upperside of the disk 1510. The solid metal disk 1510 also enables heat transfer between the LED light source 1520 and the thermal conduction ring 1530. In a preferred embodiment, the solid copper disk 1510 is coated with an epoxy, except there is no epoxy over (1) the circular power rings 1540, and (2) the thermal conduction ring 1530, so that the disk can be insulated (both thermally and electrically) to guide heat transfer and electrical conduction.

It should be noted that the circuit/heatsink disk 1510 serves multiple, but primary two, functions: a) as a circuit board or electrical signal distributor, and b) as a thermally conductive path for heat from the LED 1520 to the lamp body 1600. Such a disk 1510 is sometimes known as a "metallic core printed circuit board" (MCPCB). It does not have to be a round disk, but rather is round in the preferred embodiment. In other embodiments, for example, the disk 1510, power rings 1540, and thermal conduction ring 1530, may be triangular, square, pentagonal, hexagonal, heptagonal, octagonal, pentagonal, decagonal, or any other symmetrical or "keyed" geometry that may be drop loaded over the driver 1400 so that the power rings 1540 or other power transfer zone(s) or region(s) self-register to contact the pogo pins 1440 of the driver 1400 and so the thermal conduction ring 1530 or other thermal transfer zones(s) or region(s) may be positioned for self-registry with the housing as discussed below. It should also be noted that the disk 1510 will distribute some heat from the LED 1520 to the lamp body 1600 almost irrespective of the material of which it is comprised, as discussed below. So, the disk 1510 need not be made of copper and instead could be made of FR4 (i.e., glass reinforced epoxy laminate sheets), FR4 with an attached heat dissipation element, a metal-clad FR4 disk or with layers of metal, a ceramic disk, any metal disk, or copper. The preferred embodiment is made of copper.

Referring once again to FIGS. 5 and 6, the heat sink housing 1600 is preferably a truncated cup shape and made of a heat conductive material (e.g., copper or other metal). Suitably, the heat sink housing 1600 features a circumferential edge 1610 on its inside. In use, the housing base 1200 and heat sink housing 1600 are configured to screw or thread together, or otherwise fit together (e.g., snap-fit, threaded-lock-fit, press-fit) so that the light source unit 1500 is sandwiched between the base 1200 and an edge 1610 of the heat-sink housing 1600 whereby: the circular power rings 1540 on the underside of the disk 1510 are compressively contacting the pogo pins 1440 of the driver 1400; and the thermal conduction ring 1530 interfaces with the edge 1610 of the heat-sink housing 1600.

Yet still referring to FIGS. 5 and 6, an optic 1700 may be provided into the heat sink housing. Preferably, the optic 1700 is positioned over the LED 1520 of the light source unit 1500 and held in place by a retainer ring 1800 that threadedly interfaces with the heat sink housing 1600. The optic 1700 or retainer ring 1800 are optional features of the lighting device.

Figure 16:
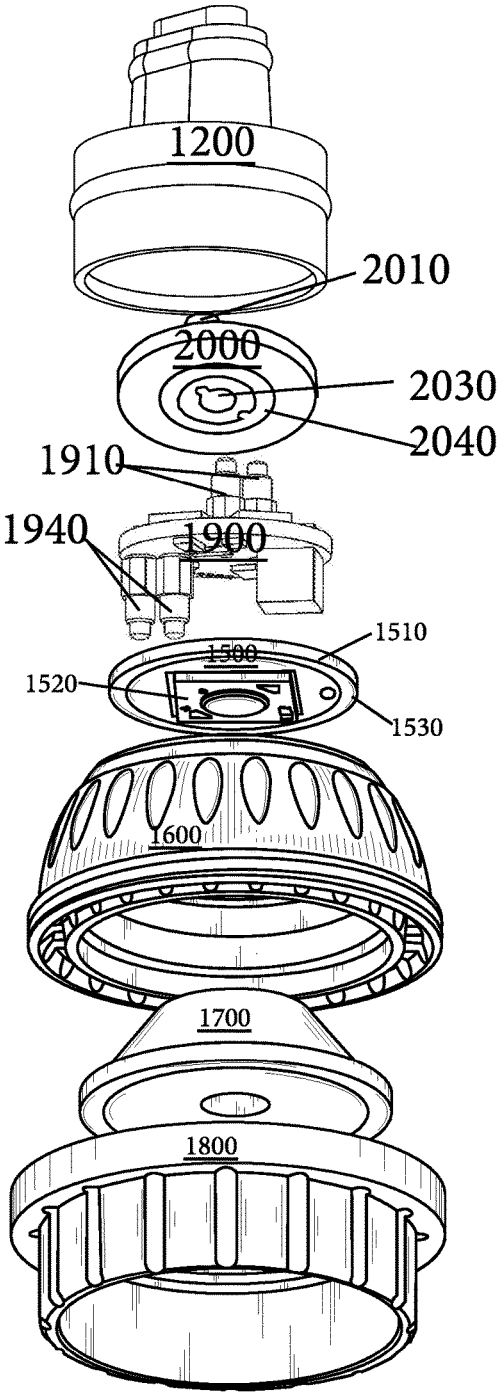
FIG. 16 is an exploded view of an alternate embodiment of an LED lamp 1000 with an alternate embodiment of a driver 1900 and a power transfer disk 2000.

FIG. 16 is an exploded view of an alternate embodiment of an LED lamp 1000 with an alternate embodiment of a driver 1900 and a power transfer disk 2000. As shown, the lamp 1000 is the same as the previously disclosed embodiment except the driver 1400 of the old embodiment is replaced by a new embodiment of a driver 1900 and a power transfer disk 2000. More specifically, the pins 1410 of the earlier embodiment are replaced with pogo pins 1910 or other electromechanical or spring-loaded electrical contact and a power transfer disk 2000 with electrical contacts 2010 on one side for receiving wires from a power source and power transfer regions 2030/2040. In a preferred embodiment, the pogo pins 1910 are configured for pressed contact with said power transfer regions 2030/2040, which are in electric contact with said contacts 2010 for receiving wires from a power source. In this manner the lamp 1000 of FIG. 16 may suitably be assembled.

Figure 17:
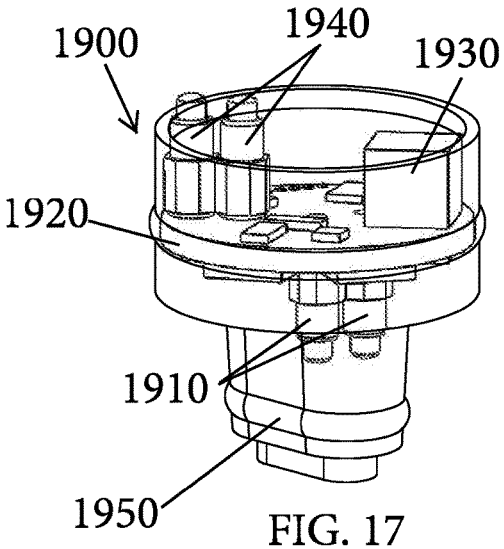
FIG. 17 is a perspective view of an embodiment of the driver 1900.
Figure 18:
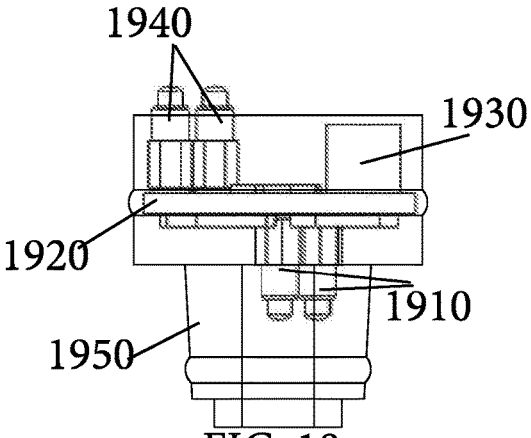
FIG. 18 is a side view of the embodiment of the driver 1900.
Figure 19:
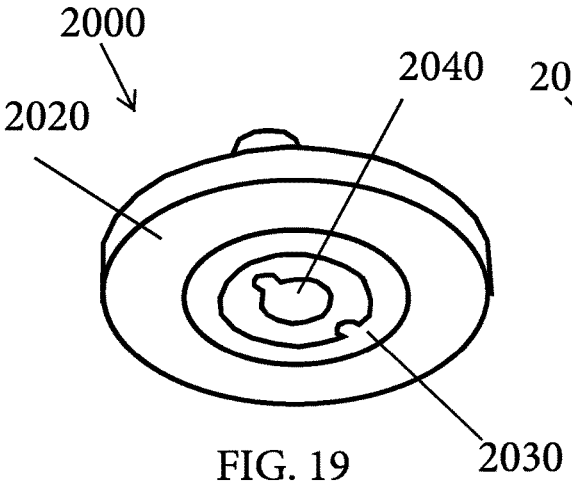
FIG. 19 is a top perspective view of the power transfer disk 2000.
Figure 20:
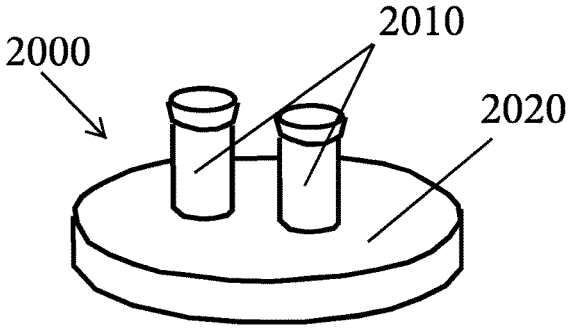
FIG. 20 is a bottom perspective view of the power transfer disk 2000.
Figure 21:
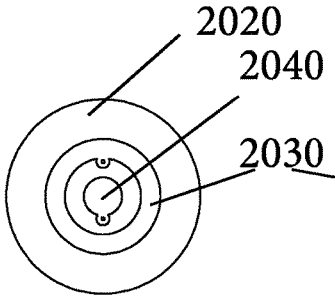
FIG. 21 is a top view of the power transfer disk 2000.
Figure 22:
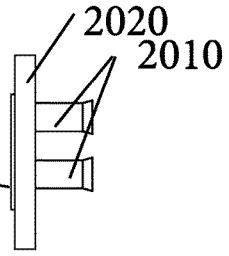
FIG. 22 is a side view of the power transfer disk 2000.

FIGS. 17 and 18 respectively illustrate a top perspective view of the driver 1900 and a side view of the driver 1900. Referring to FIGS. 17 and 18, the driver 1900 is preferably a disk-shaped board 1920 with electrical pogo pins 1910 disposed on the underside of the disk 1920. In use, the pins 1910 are ultimately for electrically contacting a power source (not shown) for providing power to the driver 1900. Suitably, the pins 1910 interact with a power transfer disk 2000 that is coupled to a power source. See FIG. 16. Suitably, the disk 1920 further features electronics 1930 or circuitry for voltage transformation of power from the power source, wherein said electronics are in electrical communication with said pogo pins 1910. Finally, the disk features pogo pin electrical contact points 1940 that are in electrical contact with the electronics 1930. The pogo pins 1940 or 1910 may be located on the outer circumference of the disk 1910 and may preferably be arranged side-by-side radially in a row.

FIGS. 19 through 22 respectively illustrate a top perspective view of the power transfer disk 2000, a bottom perspective view of the power transfer disk, a top view of the power transfer disk 2000, and a side view of the power transfer disk. As shown in those figures, the unit is a disk 2020 with on its topside (a) a first power transfer region 2030; and (b) a second power transfer region 2040, in this case a circular region. Referring back to FIG. 16, the power transfer disk is installed within the module 1000 by being sandwiched between the base 1200 and the driver 1900 so that the first power transfer ring 2030 on the topside of the disk 2020 is compressively contacting one of the pogo pins 1910 of the driver 1900; and the second power transfer region 2040 on the topside of the disk 2020 is compressively contacting the other one of the pogo pins 1910 of the driver 1900. As discussed further below, the shape of the circular power regions 2030/2040 and the compressibility of the pogo pings 1910 allow quick assembly of the module 1000 because driver 2000 may be drop-loaded into the base 1200 and under the driver 1900 in any orientation and with minimal regard for misalignment tolerances during assembly while nevertheless accomplishing an electrical contact between the driver 1900 and power transmission disk 2000.

A preferred embodiment of the LED lighting module minimally comprises: an LED light source; power transmission ring(s); at least one thermal conduction ring; at least one electrical contact pogo pin; a base; and a housing. The pogo pins could be almost any type of electromechanical contact, including spring loaded electromechanical contacts. In said preferred embodiment, the parts of the module may be connected by interfacing male and female threads and sandwich fits, with all of the inner assemblies and parts self-registering. However, other embodiments include connection of parts via snap-fit, twist-lock-fit, or press-it wherein the power transmission regions, areas or zones and thermal conduction regions, areas, or zones may be incorporated instead of rings. In other words, all the parts of the module may self-register, fit together, and assemble very easily, wherein the preferred embodiment utilizes round, conical, or cylindrical assemblies and units that screw and sandwich together.

Although the method and apparatus is described above in terms of various exemplary embodiments and implementations, it should be understood that the various features, aspects and functionality described in one or more of the individual embodiments are not limited in their applicability to the particular embodiment with which they are described, but instead might be applied, alone or in various combinations, to one or more of the other embodiments of the disclosed method and apparatus, whether or not such embodiments are described and whether or not such features are presented as being a part of a described embodiment. Thus the breadth and scope of the claimed invention should not be limited by any of the above-described embodiments.

Terms and phrases used in this document, and variations thereof, unless otherwise expressly stated, should be construed as open-ended as opposed to limiting. As examples of the foregoing: the term "including" should be read as meaning "including, without limitation" or the like, the term "example" is used to provide exemplary instances of the item in discussion, not an exhaustive or limiting list thereof, the terms "a" or "an" should be read as meaning "at least one," "one or more," or the like, and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that might be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases might be absent. The use of the term "assembly" does not imply that the components or functionality described or claimed as part of the module are all configured in a common package. Indeed, any or all of the various components of a module, whether control logic or other components, might be combined in a single package or separately maintained and might further be distributed across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives might be implemented without confinement to the illustrated examples. For example, block diagrams and their accompanying description should not be construed as mandating a particular architecture or configuration.

All original claims submitted with this specification are incorporated by reference in their entirety as if fully set forth herein.

We claim:

1. A lighting module, lamp or fixture comprising:

at least one light source unit defined by a disk with a light source and a thermal conduction ring on a first surface of the disk and at least one circular power ring on a second surface of the disk where said circular power ring is electrically coupled to the light source;

at least one power distribution or management circuit on a driver board, said driver board defined by a disk with a compressible electrical pin that is both (a) electrically coupled to said at least one power distribution or management circuit on the driver board and (b) disposed on a surface of the driver board;

a body or housing supporting for containing the light source and power distribution or management circuit, said body including a heat-sink edge;

where said light source unit, said driver board, and said body or housing self-register or self-align when assembled to create a lighting device; and, where with one step during assembly of said light source, the light source and the body are mechanically and thermally connected and the light source and the driver board are electrically and mechanically connected via (1) interfacing of the heat-sink edge of the body or housing and the thermal conduction ring of the light source unit, (2) interfacing of the at least one circular power ring of the light source unit and the compressible electrical pin of the driver board, and (3) compression of the electrical pin.

2. A lighting module, lamp or fixture of claim 1 wherein the light source unit features a second circular power ring and the driver board features a second compressible pin, where with said one step during assembly, said second circular power ring self-registers with said second compressible pin.

3. A method of assembling a light module, lamp or fixture comprising the steps of:

obtaining a light source unit defined by a disk with a light source and a thermal conduction ring on a first surface of the disk and a power ring on a second surface of the disk, where the power ring is electrically coupled to the light source;

obtaining a driver board disk with a circuit and a compressible pin that is electrically coupled to the circuit;

obtaining a body that includes a heat-sink edge; and wherein a single assembly step achieves 1) mechanically and thermally connecting the body and light source unit via self-registered interfacing of the heat-sink edge of the body and the thermal conduction ring of the light source unit; and, 2) electrically and mechanically connecting the light source unit and the circuit of the driver board disk via self-registered interfacing of the power ring of the light source unit and the compressible electrical pin of the driver board wherein the electrical pin compresses.

4. The method of claim 3 further comprising the steps of:

obtaining a base; and, mechanically connecting the base to the body so that the light source unit and the driver disk are contained within the body and base assembly.

5. The method of claim 4 further comprising the steps of: Placing an optic within the body so that it is aligned with the light source and securing the optic within the body via a retainer ring.

6. The method of claim 5 wherein the light source unit features a second power ring and the driver board features a second compressible pin.

7. The method of claim 6, wherein the step of "electrically and mechanically connecting the light source unit and the circuit of the driver board disk via self-registered interfacing of the power ring of the light source unit and the compressible electrical pin of the driver board wherein the electrical pin compresses" further includes self-registered interfacing of the second power ring of the light source unit and the second compressible electrical pin of the driver board wherein the second electrical pin compresses.

* * * * *